United States Patent [19]

Bushey

[11] 4,115,345

[45] Sep. 19, 1978

[54] PROCESS FOR TREATING ZIRCON-CONTAINING FOUNDRY SAND

[75] Inventor: William Raymond Bushey, Wilmington, Del.

[73] Assignee: E. I. Du Pont de Nemours and Company, Wilmington, Del.

[21] Appl. No.: 740,491

[22] Filed: Nov. 10, 1976

[51] Int. Cl.[2] ..... C08K 9/02

[52] U.S. Cl. ..... 260/38; 106/288 B; 428/404; 428/405

[58] Field of Search ..... 106/288 B; 428/404, 428/405; 260/DIG. 40, 42.15, 38

[56] References Cited

U.S. PATENT DOCUMENTS

| | | | |
|---|---|---|---|
| 2,357,089 | 8/1944 | Daiger et al. | 106/308 B X |
| 2,888,418 | 5/1959 | Albanese et al. | 428/404 X |
| 2,912,406 | 11/1959 | Less et al. | 428/404 X |
| 3,074,802 | 1/1963 | Alexander et al. | 260/DIG. 40 X |
| 3,817,776 | 6/1974 | Gringras | 428/404 X |

*Primary Examiner*—Sandra M. Person

[57] ABSTRACT

Process for treating zircon-containing foundry sand by intimately contacting the sand with an aqueous solution of an alkali metal silicate and isolating the sand from the solution. The treated sand is useful as the sand component of resin molds and cores.

6 Claims, No Drawings

PROCESS FOR TREATING ZIRCON-CONTAINING FOUNDRY SAND

BACKGROUND OF THE INVENTION

This invention relates generally to zirconcontaining foundry sand and, more particularly, to a process for treating zircon-containing foundry sand with an alkali metal silicate to improve the tensile strength of resin-shell molds or cores in which the treated sand is used.

Zircon-containing foundry sands include mineral sands containing as little as 15% zircon to nearly 100% zircon with only trace amounts of other components. The zircon component of the sand is believed to provide thermal stability in foundry applications. Consequently, as the amount of zircon present in the foundry sand increases so does the thermal stability. Zircon-containing foundry sand is widely used as the major component of high-performance resin-shell molds and cores because it can be bonded and worked in the same manner as silica sands, has high thermal stability, and provides improved casting surface finishes relative to silica sands. Zircon-containing resin-shell molds and cores are conventionally prepared by contacting a mixture of resin and sand or, preferably, a resin-coated sand with a preheated metal pattern. The resin, upon curing, acts to bind the particles of sand in the form of the metal pattern.

While zircon-containing resin-shell molds and cores exhibit superior properties relative to silica resin molds, numerous defects can still occur during the casting process. Since the resin mold must be strong enough to contain the molten metal until it solidifies, sufficient resin binder must be present so that the resin-shell mold will maintain structural integrity during the solidification process. Traditionally about 3% by weight of resin is the minimum required for a sufficiently strong bond. However, at amounts of resin high enough to insure structural integrity of the mold, defects caused by the decomposition of the resin can occur. These "gas defects" are caused by the penetration of gaseous decomposition products into the molten or solidifying metal and result in pin holes and scarring of the resulting metal shape. Furthermore, since the mold must collapse after solidification, high amounts of resin can at least partially prevent collapse of the mold and cause skakeout problems.

This invention provides for a process for treating zircon-containing foundry sand which provides resin molds containing the treated sand with exceptionally high strength at low resin loading.

SUMMARY OF THE INVENTION

In accordance with the invention there is provided a process for treating zircon-containing foundry sand by (i) intimately contacting the zircon sand with an aqueous solution containing at least 0.1 g/liter, and preferably from 0.4 to 6.0 g/liter, of an alkali metal silicate and (ii) isolating the zircon sand from the aqueous solution.

The zircon-containing sand prepared in accordance with the invention can be incorporated in resin molds in the conventional manner and provides resin molds generally exhibiting twice the tensile strength of molds containing zircon sand which has not been treated with an alkali metal silicate in accordance with the invention.

DETAILED DESCRIPTION OF THE INVENTION

The zircon-containing sand, useful in the practice of the invention, consists essentially of from 15% to 100% by weight of zirconium silicate, based on the weight of the sand, and from 0% to 85% by weight of at least one of aluminum silicate, iron silicate, iron titanate, and silicon dioxide, i.e., silica, based on the weight of the sand. The zirconcontaining sand can be a naturally occurring mineral sand or a mixture of mineral sands. Zircon itself is a commercially available naturally occurring mineral sand consisting essentially of zirconium silicate with minor amounts of free silica, e.g., less than 2% by weight, and commonly less than 0.5% by weight, calculated as $SiO_2$. Another commercially available zircon-containing foundry sand is composed primarily of zircon and aluminum silicates with less than 20% by weight of iron silicate, titanium silicate and free silica.

The zircon-containing foundry sand prepared according to the invention is believed to consist essentially of particulate zircon-containing sand and from 0.006% to 0.2% by weight of an alkali metal silicate. Sodium silicate is preferred for reasons of availability and economics. The alkali metal silicate is believed to be in the form of a surface coating on the zirconium silicate particles. The surface coating may not be continuous and may consist of particles of alkali metal silicate in separate association with the surface of the sand particles.

The zircon-containing foundry sand is treated by intimately contacting the zircon-containing sand with an aqueous solution of alkali metal silicate. Intimate contact can conveniently be achieved by stirring a slurry of zircon sand and aqueous alkali metal silicate. The temperature at which the contact is made is not particularly critical and any temperature at which the aqueous solution is fluid can be employed but, for convenience, ambient temperature is preferred.

To provide sufficient alkali metal silicate to contact substantially all the surface of the zirconium silicate particles, the aqueous solution should contain at least 0.1 g/liter of alkali metal silicate and sufficient solution to wet all surfaces of the sand should be used. The upper limit of the concentration of the alkali metal silicate is the limit of the solubility of the particular alkali metal silicate chosen. To provide the best combination of adequate surface treatment and economy, a concentration of 0.4 g/liter to 6.0 g/liter is preferred.

The duration of the contact depends primarily on the concentration of the aqueous solution of alkali metal silicate, i.e., the less the concentration of the aqueous solution, the greater the contact time. If the aqueous solution is at the lowest recommended concentration, i.e., 0.1 g/liter, several hours are usually necessary to achieve adequate surface treatment, whereas at highest concentrations less than five minutes are usually necessary, assuming mild agitation at room temperature. In the preferred concentration range from 0.4 g/liter to 6.0 g/liter, 30 minutes of mild agitation, such as provided by stirring, is adequate.

The silicate-treated zircon-containing sand can be isolated from the slurry by conventional means, such as filtration. The isolated composition can be dried, without further treatment, or washed with water prior to drying, and used to form resin molds. For processing convenience and highest performance in use, it is preferred that the isolated zircon sand composition not be washed prior to drying. However, in either case the isolated silicate-treated zircon-containing sand exhibits superior performance as a resin mold relative to untreated zircon-containing sand.

The silicate-treated zircon-containing sand of the invention can be utilized in forming resin-shell molds or cores in the same way as is currently practiced using conventional zircon sand and silica sand. The process of preparing resin-shell molds is well known in the art and is described in detail in Chapter 21, pages 207–232 of Harry D. Dietert, *Foundry Core Practice,* Third Edition, American Foundrymen's Society, Des Plaines, Illinois, 1966. The entire disclosure of that chapter is hereby incorporated by reference and portions of that chapter dealing with preferred practice are discussed below.

To form a resin-shell mold the silicate-treated zircon-containing sand is mixed with a thermosetting resin, i.e., a polymer which does not melt at elevated temperatures. It is preferred that the sand and resin be mixed in such a way as to coat the sand particles to alleviate dusting and form a more uniform mold. A common procedure to coat the sand involves thoroughly manually or mechanically mixing the sand with a resin solution.

By far the most common resins utilized in resin-shell molding are phenol-formaldehydes. These resins are known as the "two-step" resins, because two basic process steps are practiced in preparing them. First, a phenolic resin, referred to as novalak, is prepared. Then the phenolic resin is mixed with hexamethylenetetramine, known as hexa, and a reaction between the phenolic resin and the formaldehyde in the hexa takes place to form the phenol-formaldehyde resin upon curing.

Resins, known in the art as "no-bake" resins, can also be utilized in forming resin molds. No-bake resins require no external heating to cure and the most commonly used no-bake resin of the thermosetting type is furan. Furan resins are thermosetting resins derived from the catalyzed polymerization of monomers such as furfuryl alcohol at ambient temperatures. Unlike phenolic resins, furan resins require no external heating to cure. However, sand coated with furan monomer cannot be stored without curing taking place.

In general a resin-coated zircon-containing foundry sand will consist essentially of from 95% to 99.5% by weight of the zircon-containing foundry sand, based on the weight of the resin-coated zircon-containing foundry sand and from 0.5% to 5% by weight of resin, based on the weight of the zircon-containing foundry sand.

After the sand and resin are thoroughly mixed the resin-coated sand is placed in a mold and, in the case of phenolic resins, heated to temperatures from 210° C. to 430° C. for a few minutes to several hours depending on the size of the sample. When the silicate-treated zircon-containing sand of the invention is utilized as the sand component of the mold, the resulting mold generally exhibits twice the tensile strength of the mold using conventional zircon-containing sand at the same resin loading and exhibits substantially the same tensile strength at half of the resin loading.

While this invention is not bound by any particular theory of operation, it is believed that the strength of a mold made from zircon-containing sand and phenolic resin is a function of trace impurities on the surface of the sand. These surface impurities can interfere with the formation of a strong resin to sand bond and thus lower the strength of the mold. The surface impurities commonly found on zircon-containing sand are primarily of the acidic type, such as dihydrogenphosphate ion.

While it may seem that acidic impurities might be removed by washing the zircon with base, it has been found that washing the zircon sand with aqueous sodium hydroxide at a pH above 12 destroys the performance properties, e.g., tensile strength, of the sand. Washing the zircon-containing sand with an aqueous buffer solution of potassium carbonate and potassium borate at pH 10, aqueous sodium hydroxide at pH 10, or aqueous calcium oxide at pH 11.6, 11.9, 12.1 and 12.5 was also found to be ineffective in removing acid impurities, as evidenced by substantially no increase in strength of the resin mold relative to the unwashed sand. In contrast, the alkali metal silicate solutions used in accordance with the invention, which also have a pH of about 10, provide a silica-treated zircon-containing sand which has superior strength in resin molds.

The following examples illustrate the invention.

EXAMPLE 1

An aqueous solution containing 1.4 g/liter of sodium silicate is prepared by adding 5 g of a commercially available sodium silicate solution containing 28% by weight of sodium silicate to 1 liter of water. Five hundred grams of Florida zircon sand is added to 1 liter of the aqueous solution of sodium silicate previously prepared. The resulting aqueous slurry of zircon sand is stirred for 30 minutes. The silicate-treated zircon sand is removed from the slurry by filtration, washed with water, and dried.

To determine the tensile strength, 500 g of the silicate-treated zircon sand is mulled in a mortar and pestle with 15.1 g of a commercially available novalak (phenolic) resin and 2.54 g of an accelerator consisting of 75% by weight of hexamethylenetetramine and 25% by weight of calcium stearate. Mulling is continued until a homogeneous mix is obtained. When the consistency of the mix prevents the further use of the mortar and pestle, a metal spatula is used to expose more surface area by repeatedly slicing the doughy mass. This enhances the evaporation of the solvent containing the binder. As the sand and binder mixture begins to dry, the mortar and pestle is again used to mull the sand until it will pass through a 60-mesh screen.

The coated sand is placed in a steel die designed to produce a test sample in the shape of a dog bone with a cross-sectional area of one inch (2.54 cm) by ¼ inch (0.63 cm). The coated sand is pressed into the die using a metal plate to cover the coated sand and tapping gently, but firmly, with a hammer. This method produces a test sample of coated sand weighing about 46 g. The die is placed on a hot plate at 225° C. for seven minutes to preheat the die and sample. The die and sample are then placed in an oven, heated to 335° C., for 11 minutes to finally cure the sample. The cured sample and die is air cooled, after which the cured sample is removed from the die and filed to remove any rough edges which may be present. The cured sample contains about 3.5% by weight of phenol-formaldehyde resin, based on the weight of the silicate-treated zircon sand.

The cured sample is tested for tensile strength by placing it in a jig designed to accommodate the sample. The sample is then extended lengthwise until it breakes on a Model TTC, Instron Tensile Tester. The average tensile strength is found to be 560 pounds per square inch, based on the tensile strength of four identically prepared samples.

EXAMPLE 1*a*

The procedure of Example 1 is followed except that the aqueous sodium silicate solution contains 2.8 g/liter of sodium silicate and the silicate-treated zircon sand is not washed prior to drying.

The average tensile strength is found to be 1020 pounds per square inch.

Control 1

The procedure of Example 1 is followed except that the Florida zircon sand is not slurried in the aqueous sodium silicate solution prior to coating with the resin.

The average tensile strength is found to be 390 pounds per square inch.

EXAMPLE 2 AND CONTROL 2

The procedure of Example 1 is followed except that the Florida zircon sand is calcined by heating to 900° C. for 30 minutes and air cooling prior to slurrying in the aqueous solution of sodium silicate.

The average tensile strength is found to be 790 pounds per square inch.

Control 2

The procedure of Example 2 is followed except that the calcined Florida zircon sand is not slurried in the aqueous sodium silicate solution prior to coating with the resin.

The average tensile strength is found to be 390 pounds per square inch.

EXAMPLE 3

The procedure of Example 2 is followed except that the amounts of the resin and accelerator are halved so that the test sample contains 1.76% by weight of resin, based on the weight of the silicate-treated zircon sand.

The average tensile strength is found to be 350 pounds per square inch.

Control 3

The procedure of Example 3 is followed except that the Florida zircon sand is not slurried in the aqueous sodium silicate solution prior to coating with the resin.

The average tensile strength is found to be 180 pounds per square inch.

EXAMPLE 4

The procedure of Example 1 is followed except that a zircon-containing foundry sand, sold by the Du Pont Company under the trade name Zircore®, is used in place of the Forida zircon sand. The zircon-containing foundry sand utilized contains from 23% to 36% by weight of zirconium silicate, calculated as $ZrO_2$, 25% to 33% of aluminum silicate, calculated as $Al_2O_3$, 2% by weight of iron silicate, calculated as $Fe_2O_3$, 1% by weight of titanium silicate, calculated as $TiO_2$, and a maximum of 10% by weight of free silica, calculated as $SiO_2$.

The average tensile strength is found to be 520 pounds per square inch.

Control 4

The procedure of Example 4 is followed except that the zircon-containing foundry sand is not slurried in the aqueous silicate solution prior to coating with the resin.

The average tensile strength is found to be 200 pounds per square inch.

EXAMPLE 5

The procedure of Example 1 is followed except that the silicate-treated zircon sand is mixed with 9.5 g of furfural alcohol and 2.85 g of a commercially available acid catalyst and the mixture is placed into the steel die without drying or screening. The molded mixture is cured by remaining in the steel die for two hours at ambient temperature.

The average tensile strength is found to be 790 pounds per square inch.

Control 5

The procedure of Example 5 is followed except that the Florida zircon sand is not slurried in the aqueous solution of sodium silicate prior to coating with the furan resin.

The average tensile strength is found to be 520 pounds per square inch.

What is claimed is:

1. A process for treating zircon-containing foundry sand to improve the bonding strength of thermosetting resins in molds made therefrom by (i) intimately contacting zircon sand with an aqueous solution containing at least 0.1 g/liter of an alkali metal silicate, and (ii) isolating the silicate-treated zircon sand from the aqueous solution containing at least 0.1 g/liter of an alkali metal silicate.

2. A process for treating zircon-containing foundry sand according to claim 1 wherein the zircon-containing foundry sand consists essentially of 15% to 100% by weight of zirconium silicate, based on the weight of the sand, and from 0% to 85% by weight of at least one of aluminum silicate, iron silicate, titanium silicate, and silicon dioxide, based on the weight of the sand.

3. A process for preparing a zircon sand composition according to claim 1 wherein the aqueous solution contains from 0.4 g/liter to 6.0 g/liter of an alkali metal silicate.

4. A process for preparing a zircon sand composition according to claim 3 wherein the alkali metal silicate is sodium silicate.

5. A zircon-containing foundry sand prepared according to the process of claim 1.

6. A resin-coated zircon-containing foundry sand consisting essentially of from 95% to 99.5% by weight of the zircon-containing foundry sand, based on the weight of the resin-coated sand, prepared according to the process of claim 1 and from 0.5% to 5% by weight of thermosetting resin, based on the weight of the resin-coated sand.

* * * * *